US006562191B1

(12) United States Patent
Rousu et al.

(10) Patent No.: US 6,562,191 B1
(45) Date of Patent: May 13, 2003

(54) PROCESS FOR PRODUCING PULP WITH A MIXTURE OF FORMIC ACID AND ACETIC ACID AS COOKING CHEMICAL

(75) Inventors: Pasi Rousu, Oulu (FI); Päivi Rousu, Oulu (FI); Esa Rousu, Oulu (FI)

(73) Assignee: Chempolis Oy, Oulu (FI)

( * ) Notice: Subject to any disclaimer, the term of this patent is extended or adjusted under 35 U.S.C. 154(b) by 0 days.

(21) Appl. No.: 09/674,678

(22) PCT Filed: May 4, 1999

(86) PCT No.: PCT/FI99/00372

§ 371 (c)(1),
(2), (4) Date: Nov. 3, 2000

(87) PCT Pub. No.: WO99/57364

PCT Pub. Date: Nov. 11, 1999

(30) Foreign Application Priority Data

May 5, 1998 (FI) ..... 980995

(51) Int. Cl.[7] ..... D21C 11/14

(52) U.S. Cl. ..... 162/38; 162/76; 162/94; 162/95; 162/96; 162/97; 162/98

(58) Field of Search ..... 162/76, 70, 29, 162/37, 16, 38, 94, 95, 96, 97, 98, 99, 91

(56) References Cited

U.S. PATENT DOCUMENTS

| | | | | |
|---|---|---|---|---|
| 3,553,076 A | * | 1/1971 | Haas et al. | 162/76 |
| 4,904,342 A | | 2/1990 | Arnoldy et al. | |
| 5,656,130 A | * | 8/1997 | Ali | 162/65 |
| 6,139,683 A | * | 10/2000 | Nimz et al. | 162/76 |
| 6,156,156 A | * | 12/2000 | Rousu et al. | 162/76 |

FOREIGN PATENT DOCUMENTS

| | | | |
|---|---|---|---|
| CA | 2104765 | A1 | 2/1994 |
| EP | 0 584 675 | A1 | 3/1994 |
| FI | 933729 | A | 2/1994 |
| FI | 92722 | C | 12/1994 |
| FI | 95159 | C | 12/1995 |
| FI | 964466 | | 11/1996 |
| WO | WO 86/05529 | A1 | 9/1986 |
| WO | WO 95/21960 | A1 | 8/1995 |

OTHER PUBLICATIONS

International Search Report for International Application No. PC T/FI99/00372.

Finnish Search Report for Finnish Patent Application No. 980995.

*Grass Pulp For Papermaking by the Peroxyformic Acid Pulping Method*, A. Seisto et al., 1995 Pulping Conference, Book 2, 1995, pp. 487–493.

*Milox Pulping of Agricultural Plants*, A. Seisto et al., The 8th International Symposium on Wood and Pulping Chemistry, Proceeding vol. I, Oral Presentations, Jun. 1995, pp. 407–414.

*Erzeugung von Zellstoffen nach dem Formacell–Verfahren*, B. Saake et al., Das Papier, No. 10A, 1995, pp. V1–V7.

* cited by examiner

*Primary Examiner*—Steve Alvo
(74) *Attorney, Agent, or Firm*—Alston & Bird LLP

(57) ABSTRACT

A process based on formic acid cooking for producing pulp from herbaceous plants and deciduous trees by using acetic acid as an additional cooking chemical. The obtained pulp can be used in fine paper and board production as short-fibered material, for instance. The invention also relates to a process for adjusting the hemicellulose content of the pulp in connection with the formic acid cooking by using acetic acid as an additional cooking chemical.

10 Claims, No Drawings

PROCESS FOR PRODUCING PULP WITH A MIXTURE OF FORMIC ACID AND ACETIC ACID AS COOKING CHEMICAL

BACKGROUND OF THE INVENTION

The invention relates to a process based on formic acid cooking for producing pulp from herbaceous plants and deciduous trees by using acetic acid as an additional cooking chemical. The pulp produced in this manner can be used, for instance, in fine paper and board production as a short-fibered material. The invention also relates to a process for adjusting the hemicellulose content of the pulp in the formic-acid-based pulping process by using acetic acid as an additional cooking chemical.

Hemicellulose is found in plants in amount of 15 to 30% of the dry matter content. Hemicellulose and cellulose molecules are not chemically bound to each other, but they are linked by hydrogen bonds and van der Waals forces. Typically, hemicellulose is relatively easily hydrolyzed by the effect of strong alkalis and acids.

Finnish Patent Application 933 729 discloses a process for producing pulp by using acetic acid as the main cooking chemical and formic acid as an additional cooking chemical. In this method, temperature has to be raised high to 130 to 190° C., whereby the hemicellulose starts decomposing into furfural, and in addition, losses of formic acid arise from the elevated temperature.

The publication by Seisto et al., Fibre characteristics and paper properties of formic acid/peroxyformic acid birch pulps, *Nordic Pulp and Paper Research Journal*, vol. 12, issue April 1997, describes a three-stage process for producing pulp from hardwood (birch), which process employs combined formic acid and formic acid/peroxyformic acid cooking. A drawback with the process is poor strength of the pulp as compared with the kraft process. It is found that one reason for this is the low hemicellulose content, for instance. Cooking times of 2 to 4 hours that are typical of MILOX process are used in the process. To retain the hemicellulose contents, shorter cooking times, less than 2 hours, and a higher kappa level are suggested.

In formic-acid-based pulping processes, acetic acid is inherently formed to some extent during the process, since acetyl groups bound in the hemicellulose break up during the cooking and pulp washing. However, the amounts are insignificant, in the order of less than 1% of the total amount of cooking acid, so they have no effect on the hemicellulose content of the pulp.

Surprisingly it was found that by adding acetic acid to formic acid cooking it is possible to increase the hemicellulose content of the pulp almost linearly as the amount of acetic acid increases while the pulp is cooked to the same kappa number. In this manner, it is possible to adjust the hemicellulose content of the pulp in accordance with the raw material used and the final use of the pulp.

BRIEF DESCRIPTION OF THE INVENTION

The object of the invention is to provide a process based on formic acid cooking for producing pulp from herbaceous plants and deciduous trees. The process is characterized by employing acetic acid as an additional cooking chemical.

The object of the invention is also to provide a process for adjusting the hemicellulose content of the pulp in connection with the formic acid cooking by using acetic acid as an additional cooking chemical.

By the process of the invention, it is possible to reduce the hydrolysis of hemicellulose in comparison with cooking with formic acid alone at a corresponding temperature. The higher hemicellulose content of the pulp increases the total yield and other properties of the pulp are also good.

DETAILED DESCRIPTION OF THE INVENTION

The invention relates to a process based on formic acid cooking for producing pulp from herbaceous plants and deciduous trees by using acetic acid as an additional cooking chemical. The process is preferably a single-stage formic acid process. The amount of formic acid in the cooking acid is within the range of 80 to 40% and the amount of acetic acid 10% to 40%, preferably 15 to 40%. The total content of organic acids in the cooking acid is typically 75 to 90% (the rest being water).

In connection with the present invention, the cooking acid refers to an acid composition to be fed into cooking.

Cooking temperature is 110 to 140° C., preferably 115 to 125° C. and cooking time is 20 to 80 min. Cooking pressure is typically within the range of 1.5 to 3 bar.

In practice, cooking is typically performed in a single-stage, continuous, pressurized, vertical-tube reactor, in which the cooking temperature is provided by hot acids and acid vapours returned from the evaporating plant and the distillation. For herbaceous plants, the cooking acids are in general allowed to impregnate into the raw material to be cooked, for instance, in a horizontal tube reactor, in which the acid impregnation temperature is typically about 80° C. and the impregnation time is 5 to 30 min.

A regenerated mixed acid containing formic acid and acetic acid is preferably used as a cooking chemical. Regeneration of cooking chemicals is typically performed by evaporation and distillation in such a way that a strong cooking liquor is evaporated in a multistage evaporator to a concentration of 50 to 80% (dry solids content) of dissolved solids and water is distilled from the diluted acids by overpressure to a total concentration of 80 to 90% of formic acid and acetic acid, and this mixed acid is returned to cooking. The acetic acid obtained from the process is typically distilled in pressure columns to the effect that pure acetic acid is obtained as a bottom product and strong formic acid and acetic acid mixture is obtained as an overhead product, which is returned to cooking.

When using a cooking acid with high acetic acid content in accordance with the present invention, the regeneration of the acetic acid is facilitated and it can be performed with fewer regeneration columns than in known processes. The use of acetic acid together with formic acid as a cooking chemical thus improves the process economy also in regeneration of chemicals. If the acetic acid concentration of the cooking chemical is allowed to exceed 30%, such a feed composition level is achieved in three-component distillation that water, formic acid and acetic acid can be separated with two columns (otherwise 3 to 4 columns would be needed).

In the three-component distillation of formic acid, acetic acid and water, there are a plurality of azeotropic points, and with one column it is impossible to separate the components purely. To remove water from the mixture of formic acid and acetic acid, it is advantageous to use a pressure of 2 to 3 bar, so that the differences in steam pressure of the acids and the water are sufficient for the distillation to succeed. To remove the acetic acid obtained in the process a pressure of 1 to 2 bar is used.

The cooking liquor is separated from the prepared pulp by pressing or by filter washing, and counter-current washing with water is performed on the pulp with multi-stage filters typically using a low dilution factor of 0.7 to 1.3, to the effect that the total acid concentration of the recovered washing acid is 50 to 70%. The bound formic acid is removed from the pulp typically at a temperature of 50 to 95° C. the acid concentration being 5 to 50%, residence time being 1 to 3 hours.

If bleached pulp is desired, for instance, for producing fine paper, bleaching with oxidizing bleaching chemicals is performed after the cooking. The oxidizing bleach is preferably a hydrogen peroxide bleach.

When producing fine paper, the pulp, treated in accordance with the invention, obtained from the cooking and bleaching steps, is supplied to a papermaking process of fine grade paper, in which long-fibred pulp (reinforcing fibre) is combined therewith in a suitable proportion. A suitable proportion is e.g. 30 to 80% of short-fibred pulp from herbaceous plants or deciduous trees, the rest being reinforcing fibre, depending on the fibre length of the plants. Herbaceous plants need not be refined for the preparation of a pulp mix.

The invention also relates to a process for adjusting the hemicellulose content of the pulp in connection with producing a formic-acid-based pulp by using acetic acid as a cooking chemical. The conditions of the process, i.e. the amounts of formic acid and acetic acid, cooking temperature and cooking times are the same as those described above.

With the process of the present invention the hemicellulose content of the pulp can be adjusted to suit the raw material used (herbaceous plants and deciduous trees), and in addition, to suit each use of the pulp.

By adding acetic acid, xylose content indicating the hemicellulose content of the pulp can thus be adjusted in the desired manner. When the pulp is used for papermaking, it is advantageous to increase the xylose content by adding acetic acid, preferably 10 to 40%, because in this manner the strength properties of the paper can also be improved. Excessive use of acetic acid is not preferable, since in that case the kappa number tends to remain excessively high in the temperature range where the use of formic acid is most preferable. If the kappa number is lowered by raising the temperature, a range is easily achieved, where losses of formic acid start arising as a result of thermal decomposition. In the process of the present invention the losses of formic acid are minimized, since operations take place at a low temperature of 110 to 140° C., as compared with a temperature of 130 to 190° C. used in the process in accordance with Finnish Patent Application 933 729.

In papermaking, if it is desired to emphasize good optical properties, opacity and light scattering as well as high bulk, acetic acid is used only in minor quantities, preferably 10 to 15%. If it is desired to emphasize strength properties and yield, acetic acid is used in a larger quantity, preferably 20 to 50%.

If the final use of the pulp is production of dissolving pulp, acetic acid is used in very small quantities, i.e. less than 10%.

The process of the invention can use herbaceous plants and deciduous trees as raw material. Herbaceous plants generally refer to non-wood sources of fibre. The most important sources of fibre include straw, e.g. cereal straw (rice, wheat, rye, oats, barley); grasses, e.g. esparto grass, sabai grass and lemon grass; reeds, e.g. papyrus, common reed, sugar cane and bamboo; bast fibres, e.g. stalks of common flax, stalks of linseed flax, kenaf, jute and hemp; leaf fibres, e.g. manilla hemp and sisal; and seed-coat fibres, such as cotton and cotton linters. One useful raw material of importance, growing in Finland, is the reed canary grass.

Of the deciduous trees, birch is useful, for instance. The process is also found to suit e.g. chestnut, which is not considered particularly suitable for pulping so far.

Herbaceous plants used as raw material need not be pretreated, for instance, by fractionating, but the stalks, leaves, knots and spikes of the herbaceous plants can be cooked such as they are discharged from a chaffcutter in the harvesting phase, in 5 to 15 cm long pieces of straw and leaves. Thus biomass is not wasted, and short fibres are not lost.

Following examples describe the process of the invention. Following standard assay procedures were used in the examples:

- disintegration of chemical pulp for determining the pulp properties (SCAN 18:65),
- preparation of laboratory sheets/handsheets of the pulp for determining the physical properties (SCAN-C 26:76),
- drainage resistance of the pulp by the Schopper-Riegler method (SCAN-C 19:65),
- kappa number of the chemical pulps (SCAN-C 1:77)
- xylose content of the pulp (determined as pentosane content) (SCAN-C 4:61)
- grinding of the pulp in PFI mill (SCAN-C 24:67).

EXAMPLE 1

Reed canary grass pulp (600 kg) was prepared from non-fractionated reed canary grass chaff with foliage. Cooking conditions were as follows: formic acid content of the cooking liquor was 70 to 75%, acetic acid content 10% and water content 15 to 20%; cooking temperature 115 to 120° C., pressure 1.5 bar and cooking time 50 min. The obtained cellulose was bleached with two-stage alkaline hydrogen peroxide bleaching.

Fine paper was prepared on a pilot scale from the reed canary grass pulp obtained in this manner, using a fibre composition 50% reed canary grass pulp and 50% pine pulp prepared by sulphate process. The reed canary grass pulp was not refined. High-quality commercial pine/birch sulphate pulp (50% pine pulp and 50% birch pulp) was used as reference pulp. Pulps were run at speeds of 900 to 1380 m/min. The runability of the reed canary grass pulp was very good at all speeds. In comparison with the reference pulp, the reed canary grass pulp run in the same conditions was better as regards opacity, light scattering, bulk, smoothness and porosity. Both had equal tear strength, but the tensile strength of the reed canary grass pulp was somewhat lower, since the fibre length of reed canary grass is only half of that of birch. However, the strength is sufficient, even though the reed canary grass pulp was not ground. The test results are shown in the following Table 1.

TABLE 1

Results from test runs on the paper machine

| Raw material | Fibre proportions %/% | Light scattering $m^2/kg$ | Opacity % | Bulk $cm^3/g$ | Porosity ml/min | D.S. after pressing | % Tear strength cd $mNm^2/g$ | Tensile strength md Nm/g |
|---|---|---|---|---|---|---|---|---|
| RCG/P | 50/50 | 44.4 | 82.7 | 1.43 | 992 | 45.7 | 9.0 | 40.6 |
| B/P | 50/50 | 38.0 | 79.6 | 1.39 | 689 | 44.3 | 8.6 | 51.2 |

RCG = reed canary grass
P = pine kraft pulp
B = birch kraft pulp
D.S. = dry solids
cd = cross direction
md = machine direction

EXAMPLE 2

On a laboratory scale nine separate cookings were carried out for preparing chestnut pulp (chestnut purchased from France). The fibre length of chestnut pulp is close to that of herbaceous plants. Chestnut chips were cooked in following conditions: formic acid content of the cooking liquor 72%, acetic acid content 10% and water content 18%, cooking temperature 120° C., pressure 2.0 bar and cooking time 50 min. Two-stage alkaline peroxide bleaching was performed on the obtained pulp. The Schopper-Riegler number of brown pulp was 18.5, kappa number 27.6 and tensile index of a sheet test 76.2 unground. The Schopper-Riegler number of bleached pulp was 18.0, brightness 81.9% ISO and tensile index 37.5 unground.

On the basis of the test results, the obtained chestnut pulp surprisingly has fully acceptable properties.

EXAMPLE 3

Reed canary grass pulp was prepared from non-fractionated reed canary grass chaff with foliage. As a pre-treatment step, pulp absorption was performed at 80° C. for 20 min. Five cookings and a zero-test (with formic acid alone) were performed in conditions described in Table 2 here below. The table shows cooking temperatures and cooking times as well as the formic acid and acetic acid contents of the cooking liquor (the rest being water). Cooking pressure was within the range of 1.5 to 2.5 bar. Kappa number, xylose content and pulp yield were determined on the obtained pulp, which appear from Table 2, too.

TABLE 2

Preparation of brown reed canary grass pulp (FA = formic acid, AA = acetic acid)

| Number | Cooking ° C./min | Acid % FA/AA | Kappa number | Xylose | Yield |
|---|---|---|---|---|---|
| 1 | 113/55 | 73/10 | 32.6 | 7.0 | 42.2 |
| 2 | 125/30 | 73/10 | 29.8 | 7.0 | 43.7 |
| 3 | 125/50 | 53/30 | 26.7 | 15.0 | 46.9 |
| 4 | 125/60 | 43/40 | 29.6 | 14.5 | 47.0 |
| 5 | 129/40 | 43/40 | 29.2 | 14.9 | 48.1 |
| 0 | 123/25 | 83/0 | 31.4 | 7.1 | 45.5 |

It appears from the results of Table 2 that the xylose content, i.e. the hemicellulose content of the pulp increases almost linearly when the amount of acetic acid increases.

The obtained pulps were bleached by using two-stage alkaline peroxide bleaching. Table 3 shows the xylose content, yield and tensile index of the bleached pulps.

TABLE 3

Properties of bleached reed canary grass pulp

| Number | Xylose % | Yield % | Tensile index |
|---|---|---|---|
| 1 | 6.7 | 35.3 | 53.3 |
| 2 | 6.3 | 37.6 | 50.1 |
| 3 | 8.9 | 40.8 | 55.8 |
| 4 | 10.5 | 41.2 | 57.9 |
| 5 | 10.0 | 40.6 | 58.3 |
| 0 | 5.2 | 35.4 | 47.9 |

EXAMPLE 4

Bleached reed canary grass pulp was prepared from non-fractionated reed canary grass chaff with foliage. Cooking conditions were as follows: formic acid content of the cooking liquor 53%, acetic acid content 30% and water content 17%. Cooking temperature was 119° C. Cooking pressure was 1.8 bar. The reed canary grass pulp was mixed with bleached, dried pine sulphate pulp ground in PFI mill (2500 rpm). The mixed chemical pulp (reed canary grass/pine 50:50) was prepared into paper sheets and the technical properties thereof were measured. Tensile strength index of a paper sheet was 68.4, tear index 5.2 and bulk 1.28. These values met the requirements set for fine paper.

It is obvious to a person skilled in the art that as technology advances the basic idea of the invention can be implemented in a variety of ways. Thus the invention and embodiments thereof are not restricted to the above-described examples, but they may vary within the scope of the claims.

What is claimed is:

1. A formic acid based cooking process for producing pulp from herbaceous plants and deciduous trees by adjusting the hemicellulose content of pulp, said method comprising:

cooking said pulp in a cooking acid composition at a cooking temperature ranging from 110 to 140° C. for a cooking time ranging from 20 to 80 minutes, wherein said cooking acid composition includes formic acid in an amount ranging from 40 to 80% and acetic acid in an amount ranging from 10 to 30%.

2. A process according to claim 1, wherein the cooking temperature ranges from 115to 125° C.

3. A process according to claim 1, wherein a regenerated mixed acid containing formic acid and acetic acid is used as the cooking acid composition.

4. A process according to claim 3, wherein the regenerated mixed acid is obtained by evaporating the used cooking liquor to a dry solids content of 50 to 80% and distilling the mixture of formic acid, acetic acid and water thus obtained by removing water in a pressure of 2 to 3 bar and recovering the mixture of formic acid and acetic acid for use in cooking.

5. A process according to claim 1, further comprising a pulp bleaching step.

6. A process according to claim 5, further comprising using the pulp in a subsequent papermaking process.

7. A formic acid based cooking process according to claim 1 for producing pulp from herbaceous plants and deciduous trees by adjusting the hemicellulose content of pulp wherein said cooking acid composition includes acetic acid in an amount ranging from 10 to 15%.

8. A formic acid based cooking process according to claim 1 for producing pulp from herbaceous plants and deciduous trees by adjusting the hemicellulose content of pulp wherein said pulp is cooked at a cooking pressure ranging from 1.5 to 3 bar.

9. A formic acid based cooking process according to claim 1 for producing pulp from herbaceous plants and deciduous trees by adjusting the hemicellulose content of pulp wherein regenerated mixed acid containing formic acid and acetic acid included into the spent cooking liquor obtained from the cooking is used as said cooking acid composition.

10. The process according to claim 1, wherein the acetic acid ranges from 10 to 15%.

* * * * *